US009042762B2

(12) United States Patent
Satsukawa

(10) Patent No.: US 9,042,762 B2
(45) Date of Patent: May 26, 2015

(54) IMAGE FORMING APPARATUS

(71) Applicant: Takamitsu Satsukawa, Mizuho-machi, Nishitama-gun, Tokyo (JP)

(72) Inventor: Takamitsu Satsukawa, Mizuho-machi, Nishitama-gun, Tokyo (JP)

(73) Assignee: KONICA MINOLTA BUSINESS TECHNOLOGIES, INC., Tokyo (JP)

( * ) Notice: Subject to any disclaimer, the term of this patent is extended or adjusted under 35 U.S.C. 154(b) by 0 days.

(21) Appl. No.: 13/844,059

(22) Filed: Mar. 15, 2013

(65) Prior Publication Data

US 2013/0243469 A1 Sep. 19, 2013

(30) Foreign Application Priority Data

Mar. 16, 2012 (JP) ..... 2012-059960

(51) Int. Cl.
*G03G 15/00* (2006.01)

(52) U.S. Cl.
CPC ..... *G03G 15/5008* (2013.01); *G03G 15/55* (2013.01); *G03G 15/502* (2013.01)

(58) Field of Classification Search
CPC ..... G03G 15/50
USPC ..... 399/82
See application file for complete search history.

(56) References Cited

U.S. PATENT DOCUMENTS

| | | | | |
|---|---|---|---|---|
| 7,224,479 | B2 | 5/2007 | Tanaka | |
| 8,099,038 | B2 | 1/2012 | Matoba | |
| 2004/0042042 | A1 | 3/2004 | Utsunomiya | |
| 2012/0056928 | A1 * | 3/2012 | Powers et al. | 347/19 |
| 2012/0148276 | A1 * | 6/2012 | Nishikata | 399/45 |
| 2012/0269600 | A1 | 10/2012 | Kozuka | |

FOREIGN PATENT DOCUMENTS

| | | | |
|---|---|---|---|
| CN | 101639641 | A | 2/2010 |
| JP | 2000094808 | A | 4/2000 |
| JP | 2003036160 | A | 2/2003 |
| JP | 2003-066786 | A | 3/2003 |
| JP | 2004-255745 | A | 9/2004 |
| JP | 2005-031760 | A | 2/2005 |
| JP | 2006-184594 | A | 7/2006 |
| JP | 2008262103 | A | 10/2008 |
| JP | 2009-292580 | A | 12/2009 |
| JP | 2012223973 | A | 11/2012 |

OTHER PUBLICATIONS

Machine translation of Matoba JP 2009-292580 A, publication date: Dec. 17, 2009.*
Machine translation of Hayashi JP 2006-184594 A , publication date: Jul. 13, 2006.*
Machine translation of JP 2003-036160, publication date: Feb. 7, 2003.*
Machine translation of JP 2012-223973, publication date: Nov. 15, 2012.*
Japanese Office Action dated Jul. 2, 2014, in counterpart Japanese Application No. 2012-059960.
Chinese Office Action dated Dec. 31, 2014, issued in counterpart Chinese Application No. 201310079099.4.

* cited by examiner

*Primary Examiner* — Walter L Lindsay, Jr.
*Assistant Examiner* — Frederick Wenderoth
(74) *Attorney, Agent, or Firm* — Holtz, Holtz, Goodman & Chick PC

(57) ABSTRACT

An image forming apparatus has an image forming section configured to form an image on a recording sheet, a controller to execute a job, and an adjustment section configured to adjust a density of the image formed on the recording sheet by the image forming section during execution of the job. The controller discharges an inserting sheet onto the recording sheet having the image formed during the execution of the job when a value of the adjustment is larger than a predetermined value.

15 Claims, 6 Drawing Sheets

IMAGE FORMING APPARATUS

CROSS-REFERENCE TO RELATED APPLICATION

This application is based on Japanese Patent Application No. 2012-059960 filed with Japan Patent Office on Mar. 16, 2012, the entire content of which is hereby incorporated by reference.

TECHNICAL FIELD

The present invention relates to an image forming apparatus that outputs an image by printing the image on a recording sheet.

DESCRIPTION OF RELATED ART

In image forming apparatuses such as copiers, facsimiles, printers, and multi-function apparatuses having a plurality of functions of such apparatuses, an image is formed on a recording sheet by an image forming section based on image information. The formation of an image is performed based on image data in accordance with set image formation conditions (an image formation position, a color, a density, and the like). Since the image formation conditions may change temporarily or gradually in accompaniment with a running of the image forming apparatus, by performing an adjustment operation, the quality is maintained.

A recording sheet used for a printing process is fed from a sheet feeding tray and is conveyed to the image forming section. At this time, in a case where there is a change in the type of designated recording sheet or a change in the size of the recording sheet, a recording sheet is fed with the sheet feeding tray being switched to a sheet feeding tray in which recording sheets of the changed type or the changed size are housed. In addition, when there is no recording sheet in the sheet feeding tray, there is a case where a recording sheet is fed with the sheet feeding tray being switching to another sheet feeding tray in which recording sheets of the same type are housed. Furthermore, there is a case where a jamming occurs or a material such as toner is changed during a printing process.

In this way, in a case where an output condition is changed during a printing process, there is concern that the image quality changes, and the quality of a printed material may not be maintained.

Accordingly, when there is a change in the output, in order to maintain the quality of a printed material, it is necessary to check the quality or the finish of the output material. At this time, in a case where a large quantity of all the output materials is checked, a tremendous number of processes are required. Thus, in order to efficiently check the output material, the output material may be checked in a case where an output condition is changed at the time of generating the output material.

However, in a case where the image forming apparatus automatically adjusts the density of an image or changes the recording sheet during an image forming operation, a case where a jamming occurs during an image forming operation for a large quantity of recording sheets, or the like, there is a problem in that an output material to be checked is not known after the completion of an output process.

In related art, for example, an image forming apparatus has been proposed which delivers information to a specific contact through a network in a case where a specific event occurs in the image forming apparatus (see Japanese Patent Application Laid-Open No. 2003-066786).

In addition, in Japanese Patent Application Laid-Open No. 2009-292580, an image forming apparatus has been proposed which processes a print job and includes an analysis unit that analyzes the print job and an output control unit that inserts a partition sheet between a part and another part of a printed material in accordance with the analysis performed by the analysis unit and performs a shifting process for every number of sheets for which post-processing is performed.

Furthermore, in Japanese Patent Application Laid-Open No. 2006-184594, an image forming apparatus has been proposed, which is capable of appropriately responding to also a case where a plurality of inserting sheets are required to be inserted to desired positions within a document by using an inserting sheet inserting function.

However, in the related arts described above, a case where an output condition is changed is not dealt with.

SUMMARY

In general, in one aspect, the present invention relates to an image forming apparatus wherein an image is formed on a sheet. The image forming apparatus comprises an image forming section configured to form an image on a recording sheet, a controller to execute a job, and an adjustment section configured to adjust a density of the image formed on the recording sheet by the image forming section during execution of the job, wherein the controller discharges an inserting sheet onto the recording sheet having the image formed during the execution of the job when a value of the adjustment is larger than a predetermined value.

It is preferable that the above image forming apparatus further comprises a setting section configured to set at least one of a value of the adjustment, a type of the inserting sheet, and a tray for storing the recording sheet.

It is preferable in the above image forming apparatus that the setting section is enabled to set the value of the adjustment, the type of the inserting sheet, or the tray for storing the recording sheet for each of the job.

It is preferable in the above image forming apparatus that the controller discharges the inserting sheet a type of which is different from the type of the recording sheet.

It is preferable in the above image forming apparatus that the controller discharges the inserting sheet to a position where is different from a discharge position of the recording sheet.

It is preferable in the above image forming apparatus that when the controller discharges a plurality of the inserting sheets for one job, the image forming section forms a serial number on each of the inserting sheets.

It is preferable in the above image forming apparatus that when the controller discharges a plurality of the inserting sheets for one job, the image forming section forms a number of the plurality of the inserting sheets on the inserting sheet.

It is preferable in the above image forming apparatus that the controller discharges the inserting sheet before discharging of the recording sheet having the image density to which the adjustment larger than the predetermined value is performed.

It is preferable in the above image forming apparatus that when the image forming section forms a series of images on a plurality of the recording sheets, the controller discharges the plurality of the recording sheets followed by the inserting sheet.

It is preferable in the above image forming apparatus that the controller discharges the inserting sheet which has an information concerning an adjustment of image density by the adjustment section.

It is preferable in the above image forming apparatus that the information concerning the adjustment is a timing at which the image density is adjusted by the adjustment section.

It is preferable in the above image forming apparatus that the timing is represented by a page number of the recording sheet the image density on which is adjusted by the adjustment section.

It is preferable in the above image forming apparatus that the controller discharges the inserting sheet a type of which represents the information of the adjustment.

It is preferable in the above image forming apparatus that the image forming section forms the information concerning the adjustment on the sheet inserted by the controller.

According to another aspect of the present invention, an image forming apparatus comprises an image forming section configured to form an image on a recording sheet; a controller to execute a job; and a detecting section configured to detect a change of the recording sheet, a jamming, or a change of a material used for the formation of the image, wherein the controller discharges an inserting sheet onto the recording sheet having the image formed during the execution of the job when the detecting section detects the change of the recording sheet, the jamming, or the change of the material.

DETAILED DESCRIPTION OF THE PREFERRED EMBODIMENTS

Figure 1:
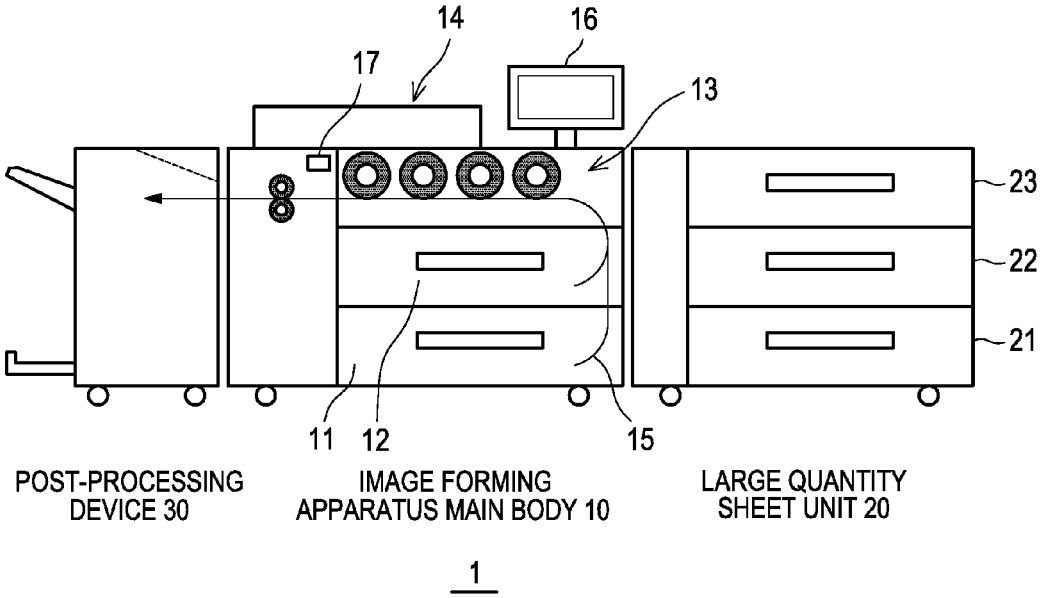
FIG. 1 is a diagram that illustrates a schematic mechanical configuration of an image forming apparatus according to an embodiment of the present invention.

Hereinbelow, typical embodiments of the present invention will be explained with reference to the drawings.

An image forming apparatus 1 is configured by an image forming apparatus main body 10, a large quantity sheet unit 20 that is connected to an upper side of the image forming apparatus main body 10, and a post-processing device 30 that is connected to a lower side of the image forming apparatus main body 10.

In this embodiment, although the image forming apparatus 1 including the large quantity sheet unit 20 and the post-processing device 30 will be described, as an embodiment of the present invention, an image forming apparatus may be configured by only the image forming apparatus main body 10 without including the large quantity sheet unit 20 and the post-processing device 30.

The large quantity sheet unit 20 includes a third sheet feeding tray 21, a fourth sheet feeding tray 22, and a fifth sheet feeding tray 23, and recording sheets are fed from each sheet feeding tray to the image forming apparatus main body 10.

The image forming apparatus main body 10 includes a first sheet feeding tray 11 and a second sheet feeding tray 12 in a lower part and can be selectively used with the large quantity sheet unit 20.

The image forming apparatus main body 10 includes an image forming section 13 that forms an image on a recording sheet fed from each sheet feeding tray and an image reading section 14 that reads an image formed on a document.

In addition, the image forming apparatus main body 10 includes a sheet conveying section 15 that feeds a recording sheet from each sheet feeding tray, sends the recording sheet to the image forming section 13, and discharges the recording sheet to the outside of the image forming apparatus main body 10.

Furthermore, in an upper part of the image forming apparatus main body 10, an operating section 16 that receives an operating input from an operator and can display information is included. The operating section 16 may be configured by a touch panel, in which an operating part and a display part are integrally formed, or the like. Here, the operating part and the display part may be configured as separate units. A controller 17 illustrated in FIG. 1 controls the image forming apparatus main body 10.

The post-processing device 30 is a device that performs predetermined post-processing for a recording sheet that has been printed and output by the image forming apparatus main body 10 and has post-processing functions such as a stapling function, a punching function, or a folding function. The post-processing device 30 may discharge a recording sheet without performing post-processing for the recording sheet.

Figure 2:
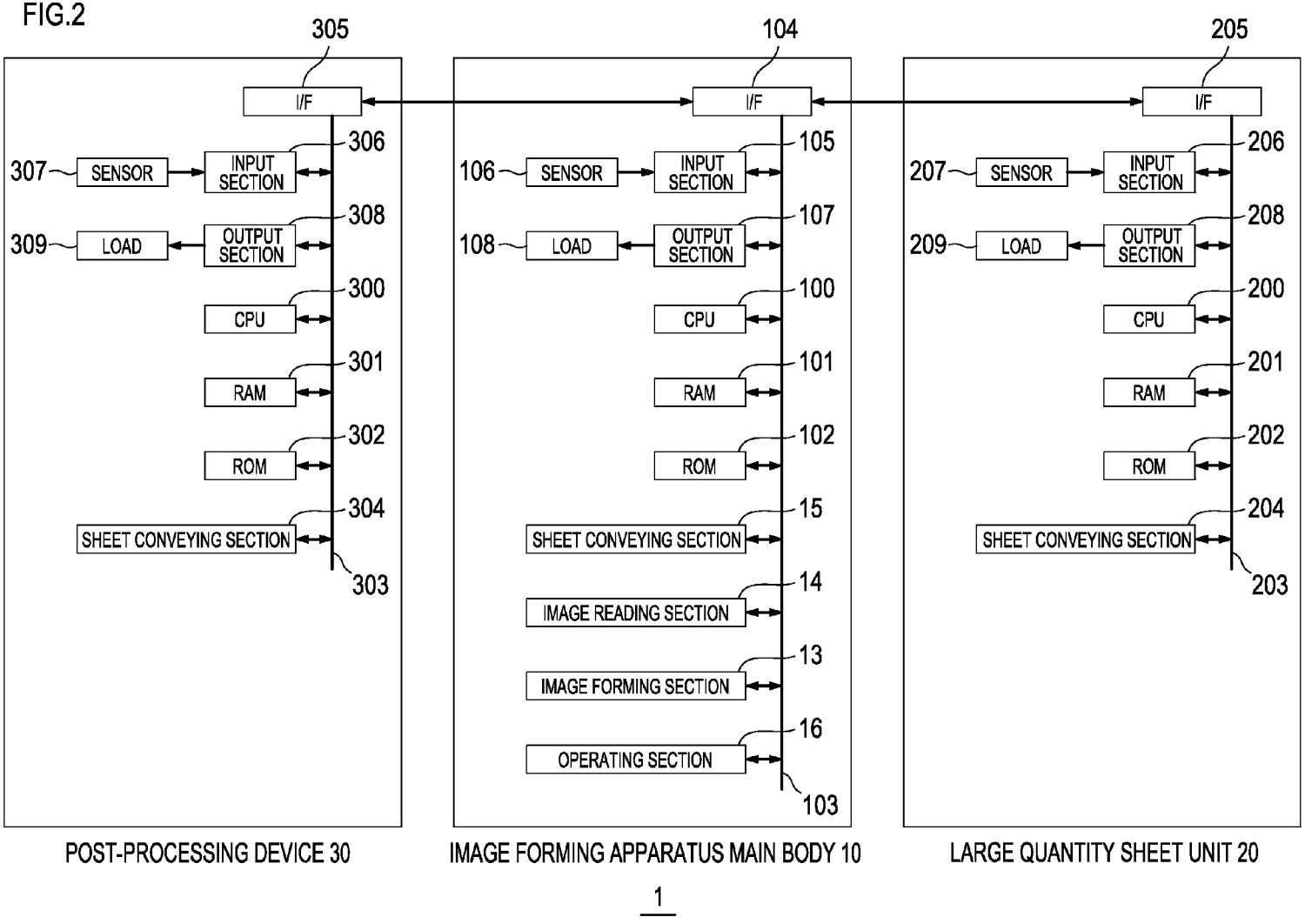
FIG. 2 is a diagram that illustrates a control block thereof.

Next, the function of the image forming apparatus 1 will be described based on a control block diagram illustrated in FIG. 2.

The image forming apparatus main body 10 includes a CPU 100, a RAM 101 that is a temporary storage area, and a ROM 102 that stores a program operating the CPU 100 and the like. The CPU 100, the RAM 101, and the ROM 102 configure the controller 17.

The CPU 100, the RAM 101, and the ROM 102 are connected to a common bus 103, and the image forming section 13, the image reading section 14, the sheet conveying section 15, and the operating section 16 described above are connected to the common bus 103. The image forming section 13, the image reading section 14, the sheet conveying section 15, and the operating section 16 are controlled by the controller 17 through the common bus 103.

The image forming section 13, for example, forms an image on a recording sheet using electrophotography. The image forming section 13 includes an image carrier, a charger that is arranged on the periphery of each image carrier, a writing section that is configured by a laser diode (LD) or the like, and a developing unit for each color. The image forming section 13 further includes a transfer section and a fixing section.

The surface of the image carrier that is electrically charged by the charger is exposed to light based on image data by the writing section. From this, a latent image that is based on the image data is formed on the surface of the image carrier. The developing unit develops the latent image using toner, thereby forming a toner image. The toner image is transferred to a conveyed recording sheet by the transfer section. The recording sheet to which the toner image has been transferred is conveyed to the fixing section. The toner image transferred to the recording sheet is heated so as to be fixed by the fixing section. After the transfer of the toner image, toner remaining in a photoreceptor is removed by a cleaning section.

In a writing process performed by the writing section, the image density is adjusted by the controller 17.

For example, a toner patch is formed on the image carrier at predetermined timing, and the amount of attached toner is detected by an attachment amount detecting section not illustrated in the figure. The controller 17 performs control of the image forming section 13 based on the detected value of the amount of attached toner such that an image of an appropriate image density is output. The controller 17 and the image forming section 13 configure the adjustment section that adjusts the image density.

The sheet conveying section 15 feeds recording sheets from the sheet feeding tray and conveys the recording sheets and includes a conveyance path, sheet feeding rollers, and conveyance rollers. The sheet conveying section 15 is controlled by the controller 17. The controller 17 performs control of switching between sheet feeding trays from which a recording sheet is fed. Accordingly, the controller 17 and the sheet conveying section 15 have a function of switching between sheet feeding trays.

The operating section 16 is controlled by the controller 17 and can perform a display of various kinds of information or an operating input. In other words, in the operating section 16, an input of mechanical settings such as printing settings or operation control conditions of the image forming apparatus 1, settings relating to an output or the like, setting sheet information (the size and the sheet type) of each sheet feeding tray, and the like can be performed. In a case where the controller 17 performs control of switching between sheet feeding trays from which recording sheets are fed, when the set sheet information is different between before and after the switching, the controller 17 detects a change of the recording sheet. In addition, the selection of a sheet discharged onto the recording sheet having the image formed during the execution of the job to be inserted or the selection of a sheet feeding tray when an output condition is changed, the setting of an event, in which the output condition is changed, for which the sheet is to be inserted, the setting of a value of the adjustment amount that is the reference for the sheet insertion, and the like can be performed using the operating section 16. Such settings are controlled by the controller 17 so as to be operated on a mechanical setting screen or an appropriate menu screen.

An operating section performing an operation and a display section performing a display may be separately configured, or both the operation and the display may be configured to be performed by the operating section. As a unit that handles the display, there is a unit having a panel shape such as a CRT, a liquid crystal, or an EL. As a unit that handles the operation, there is a touch panel detecting a coordinate position corresponding to a button position of a display panel or the like, a mouse, a touch pen, a tablet, or the like.

In addition, an I/F 104 is connected to the common bus 103. The I/F 104 is connected to an I/F 205 of the large quantity sheet unit 20 and an I/F 305 of the post-processing device 30. The controller 17 is configured to communicate with the large quantity sheet unit 20 and the post-processing apparatus 30 through the I/F 104.

Furthermore, an input section 105 is connected to the common bus 103, and a sensor 106 is connected to the input section 105. By employing such a configuration, a detection result acquired by the sensor 106 is transmitted to the input section 105, and the detection result received by the input section 105 is transmitted to the controller 17 through the common bus 103. The detection result transmitted to the controller 17 is used for various control operations and the like. As the sensor 106, there is a sensor that detects a recording sheet conveyed in the sheet conveying section 15. When a recording sheet is not detected for a predetermined time by the sensor 106 during the conveyance of the recording sheet, the controller 17 can detect a jamming in the image forming apparatus main body 10.

In addition, as the sensor 106, there is a sensor detecting the attachment or detachment of a unit that is installed to the image forming apparatus 1. For example, in a case where it is detected that a toner bottle is removed and a new toner bottle is installed, the controller 17 can detect a change of a material used for the formation of the image. In other words, the sensor 106 and the controller 17 configure a detecting section.

In addition, an output section 107 is connected to the common bus 103, and a load 108 is connected to the output section 107. A control signal or power is transmitted to the load 108 by transmitting a control signal to the output section 107 from the controller 17, whereby each section of the image forming apparatus 1 operates.

A non-volatile storage section not illustrated in the figure is connected to the controller 17 in a controllable manner. As the non-volatile storage section, for example, there is a flash memory or an HDD. In the non-volatile storage section, initial printing setting information, mechanical setting information such as a process control parameter, settings of the sheet information (the size and the sheet type) of each sheet feeding tray, user set values, and the like of the image forming apparatus 1 are stored so as to be readable. Such settings and the like may be stored as initial values in advance or may be input through the operating section 16.

In addition, in the non-volatile storage section, the type of a sheet to be inserted when the output condition is changed, a setting of sheet feeding tray feeding the sheet when the output condition is changed, the setting of an event for changing the output condition for which the sheet is to be inserted, a list of events for changing the output condition selected at the time of performing the setting, a value of the adjustment amount that is the reference for the sheet insertion, and the like are stored. Such settings may be performed for each job.

The large quantity sheet unit 20 includes a CPU 200, a RAM 201 that serves as a temporary storage area, and a ROM 202 that stores a program for operating the CPU 200 and the like. These are interconnected through a common bus 203. The CPU 200, the RAM 201, and the ROM 202 configure a large quantity sheet unit control section.

In addition, a sheet conveying section 204 is connected to the common bus 203, and the sheet conveying section 204 conveys a recording sheet inside the large quantity sheet unit 20 under the control of the large quantity sheet unit control section. The sheet conveying section 204 is connected to the sheet conveying section 15 of the image forming apparatus main body 10.

Furthermore, an I/F 205 is connected to the common bus 203. The large quantity sheet unit control section is configured to communicate with the image forming apparatus main body 10 through the I/F 205.

In addition, an input section 206 is connected to the common bus 203, and a sensor 207 is connected to the input section 206. A detection result acquired by the sensor 207 is transmitted to the input section 206, and the detection result received by the input section 206 is transmitted to the large quantity sheet unit control section through the common bus 203. The detection result transmitted to the large quantity sheet unit control section is used for various control operations and the like. As the sensor 207, there is a sensor that detects a recording sheet conveyed by the sheet conveying section 204. When a recording sheet is not detected for a predetermined time by the sensor 207 during the conveyance of the recording sheet, the large quantity sheet unit control section can detect a jamming in the large quantity sheet unit 20. In other words, the sensor 207 and the large quantity sheet unit control section have a jamming detecting function. The occurrence of the jamming is transmitted to the controller 17 through the I/F 205 and the I/F 104.

Furthermore, an output section 208 is connected to the common bus 203, and a load 209 is connected to the output section 208. A control signal or power is transmitted to the load 209 by transmitting a control signal to the output section 208 from the large quantity sheet unit control section, whereby each section of the large quantity sheet unit 20 operates. In addition, a control signal is transmitted to the large quantity sheet unit 20 from the controller 17 through the I/F 104 and the I/F 205.

The post-processing device 30 includes a CPU 300, a RAM 301 that serves as a temporary storage area, and a ROM 302 that stores a program for operating the CPU 300 and the like. The CPU 300, the RAM 301, and the ROM 302 are interconnected through a common bus 303 and configure a post-processing device controller.

In addition, a sheet conveying section 304 is connected to the common bus 303. The sheet conveying section 304 conveys a recording sheet inside the post-processing device 30 under the control of the post-processing device control section. The sheet conveying section 304 is connected to the sheet conveying section 15 of the image forming apparatus main body 10.

Furthermore, an I/F 305 is connected to the common bus 303. The post-processing device control section is configured to communicate with the image forming apparatus main body 10 and the post-processing device 30 through the I/F 305.

In addition, an input section 306 is connected to the common bus 303, and a sensor 307 is connected to the input section 306. A detection result acquired by the sensor 307 is transmitted to the input section 306, and the detection result received by the input section 306 is transmitted to the post-processing device control section through the common bus 303. The detection result is used for various control operations and the like. As the sensor 307, there is a sensor that detects a recording sheet conveyed by the sheet conveying section 304. When a recording sheet is not detected for a predetermined time by the sensor 307 during the conveyance of the recording sheet, the post-processing device control section can detect a jamming in the post-processing device 30. In other words, the sensor 307 and the post-processing device control section have a jamming detecting function. The occurrence of the jamming is transmitted to the controller 17 through the I/F 305 and the I/F 104.

Furthermore, an output section 308 is connected to the common bus 303, and a load 309 is connected to the output section 308. A control signal or power is transmitted to the load 309 by transmitting a control signal to the output section 308 from the post-processing device control section, whereby each section of the post-processing device 30 operates. In addition, a control signal is transmitted to the post-processing device 30 from the controller 17 through the I/F 104 and the I/F 305.

Figure 3:
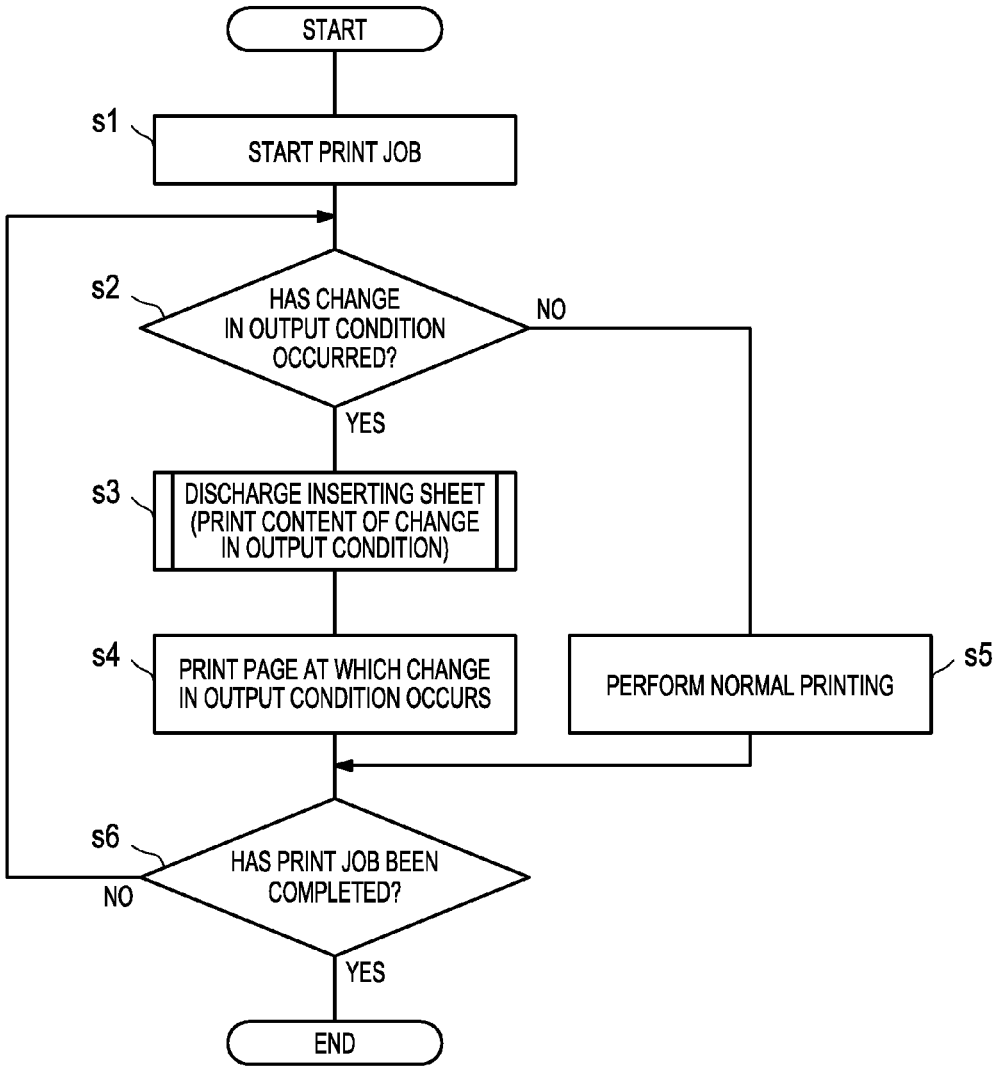
FIG. 3 is a flowchart that illustrates the sequence of inserting an inserting sheet in accompaniment with the occurrence of a change in an output condition.

Next, the sequence of inserting an inserting sheet when a change in the output condition occurs during the output of a job will be described with reference to a flowchart illustrated in FIG. 3. The following sequence is performed by the controller 17.

The output of a print job is started in accordance with a user's output instruction or the like in Step s1. After the output is started, it is determined whether or not a change in the output condition occurs in Step s2. In a case where a change in the output condition does not occur (NO in Step s2), normal printing is performed in Step s5, and it is determined whether or not the output of the print job has been completed in Step s6. In a case where the output of the job has been completed (YES in Step s6), the process ends. On the other hand, in a case where the output of the job has not been completed (NO in Step s6), the process is returned to Step s2, and the occurrence of a change in the output condition is determined.

In a case where it is determined that there has been a change in the output condition in Step s2 (YES in Step s2), an inserting sheet is discharged onto a recording sheet having the image formed during the execution of the job in Step s3. Here, as the inserting sheet, either a sheet of the same type as that of the recording sheet or a sheet of a type different from that of the recording sheet may be used. In addition, information relating to a change that has occurred in the output condition may be acquired as the type of the inserting sheet. As the type of the sheet, there is a paper type, a sheet size, the weight, or the like. By associating the type of a sheet and the information relating to a change in the output condition with each other in advance, necessary information can be acquired from the type of a sheet. A user may be notified of an associated content by displaying the content on the operating section or the like.

In addition, by discharging an inserting sheet to a position different from the discharge position of the recording sheet, a user can easily perceive the occurrence of a change in the output condition. As examples of the method of discharging an inserting sheet, there are a method in which the inserting sheet is discharged with being rotated and a method in which the inserting sheet is discharged with being shifted in a direction perpendicular to the discharge direction.

In addition, when an inserting sheet is discharged, the image forming section 13 may print the content of a change in the output condition onto the inserting sheet. Furthermore, in a case where a change in the output condition, for which an inserting sheet is to be discharged, occurs a plurality of times in one job, the image forming section 13 may print consecutive numbers on inserting sheets. From this, in a case where a plurality of changes in the output condition occur in one job, and a plurality of inserting sheets are discharged, a user can check the order of occurrences of the changes in the output condition based on the consecutive numbers printed on the inserting sheets. In addition, the user can easily check whether or not there has been a prior change in the output condition. Furthermore, the user can extract the inserting sheets without omission. Here, a plurality of times of the occurrences of the changes in the output condition may be of occurrences of the same event or in events different from each other.

After the inserting sheet is discharged, an image is printed on a recording sheet for a page at which a change in the output condition occurs in Step s4. In this example, although an inserting sheet is discharged immediately when a change in the output condition occurs, after an image is printed on a recording sheet for the page at which the change in the output condition occurs, an inserting sheet may be discharged. In such a case, the timing at which the change in the output condition occurs may be formed on the inserting sheet by the image forming section 13. As the timing, a page number of the recording sheet, at which a change in the output condition occurs, or the like may be used. From this, the user can easily check the timing of the occurrence of the change.

Thereafter, it is determined whether or not the output of the print job has been completed in Step s6. In a case where the output of the job has been completed (YES in Step s6), the process ends. On the other hand, in a case where the output of the job has not been completed (NO in Step s6), the process is returned to Step s2, and a determination on the occurrence of a change in the output condition is performed. In addition, in a case where a change in the output condition, for which a inserting sheet is to be discharged, occurs a plurality of times in the output of one job, after the print job is completed, the inserting sheet on which the number of the plurality of inserting sheets is printed may be printed.

Figure 4:
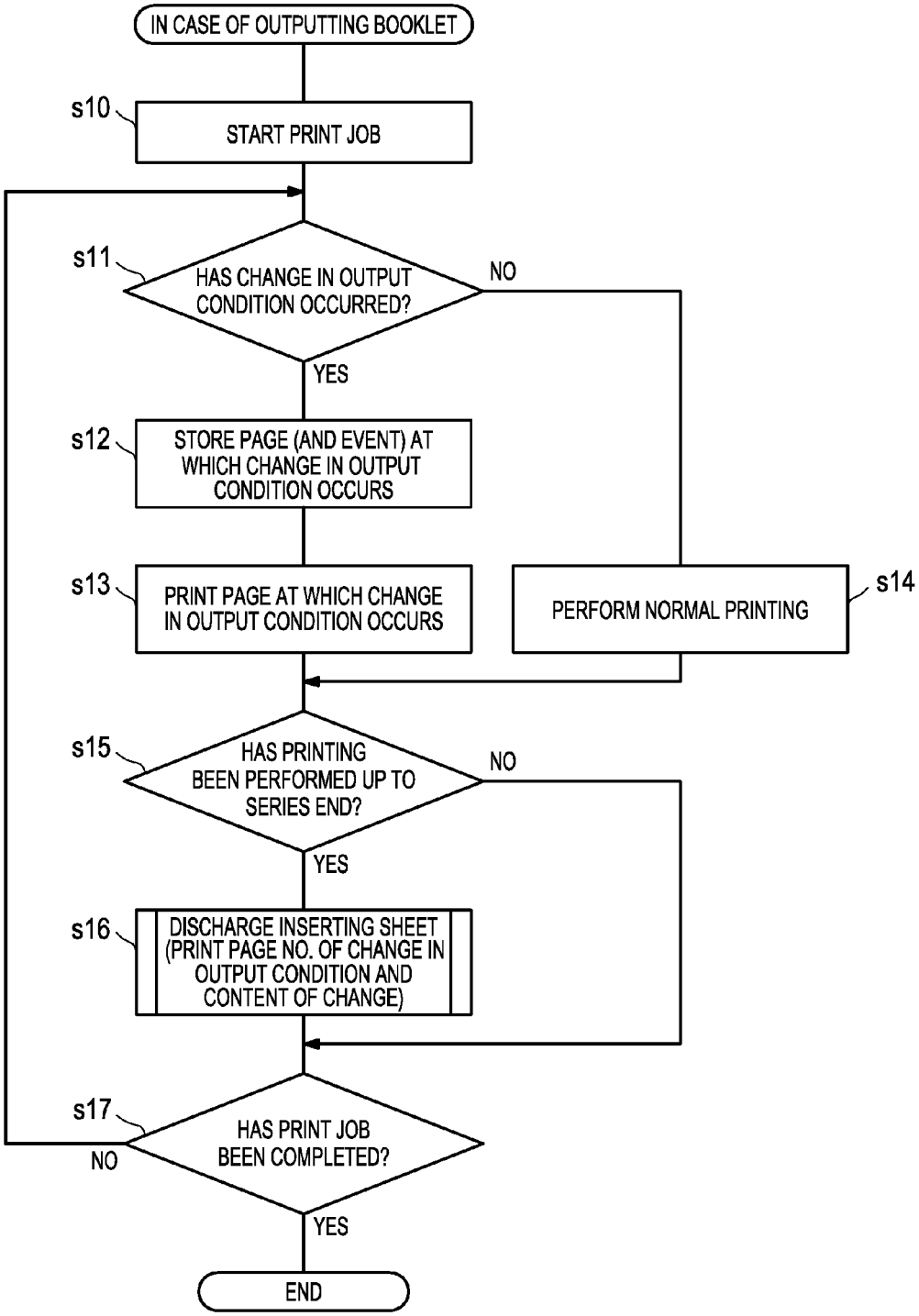
FIG. 4 is a flowchart that illustrates the sequence of inserting an inserting sheet in accompaniment with the occurrence of a change in an output condition in the case of outputting a booklet.

Next, a case will be described with reference to a flowchart illustrated in FIG. 4 in which a job of forming a series of images on a plurality of recording sheets is performed. The following sequence is performed by the controller 17.

An output of a print job for outputting a booklet is started in accordance with a user's output instruction or the like in Step s10. After the output is started, it is determined whether or not a change in the output condition has occurred in Step s11. In a case where a change in the output condition has not occurred (NO in Step s11), normal printing is performed in Step s14, and it is determined whether or not a series of images have been printed up to the end in Step s15.

In a case where it is determined that there has been a change in the output condition in Step s11 (YES in Step s11), a page at which the change in the output condition has occurred or both the page and the change event are stored in the RAM or the like in Step s12. Subsequently, an image is printed on a recording sheet for the page at which the change in the output condition has occurred in Step s13. Thereafter, a determination whether or not the series of images have been printed up to the end is performed in Step s15. In a case where the series of images have been printed up to the end (YES in Step s15), an inserting sheet on which a page No., at which the change in the output condition has occurred or both the page No. and the content of the change are printed, is discharged to the position of a normal output material in Step s16, and it is determined whether or not the print job has been completed in Step s17. In a case where printing is not performed up to the series end (NO in Step s15), it is determined whether or not the output of the print job has been completed without discharging an inserting sheet in Step s17.

In a case where it is determined that the output of the job has been completed in Step s17 (YES in Step s17), the process ends. On the other hand, in a case where the output of the job has not been completed (NO in Step s17), the process is returned to Step s11, and the determination whether a change in the output condition has occurred is performed.

Figure 5:
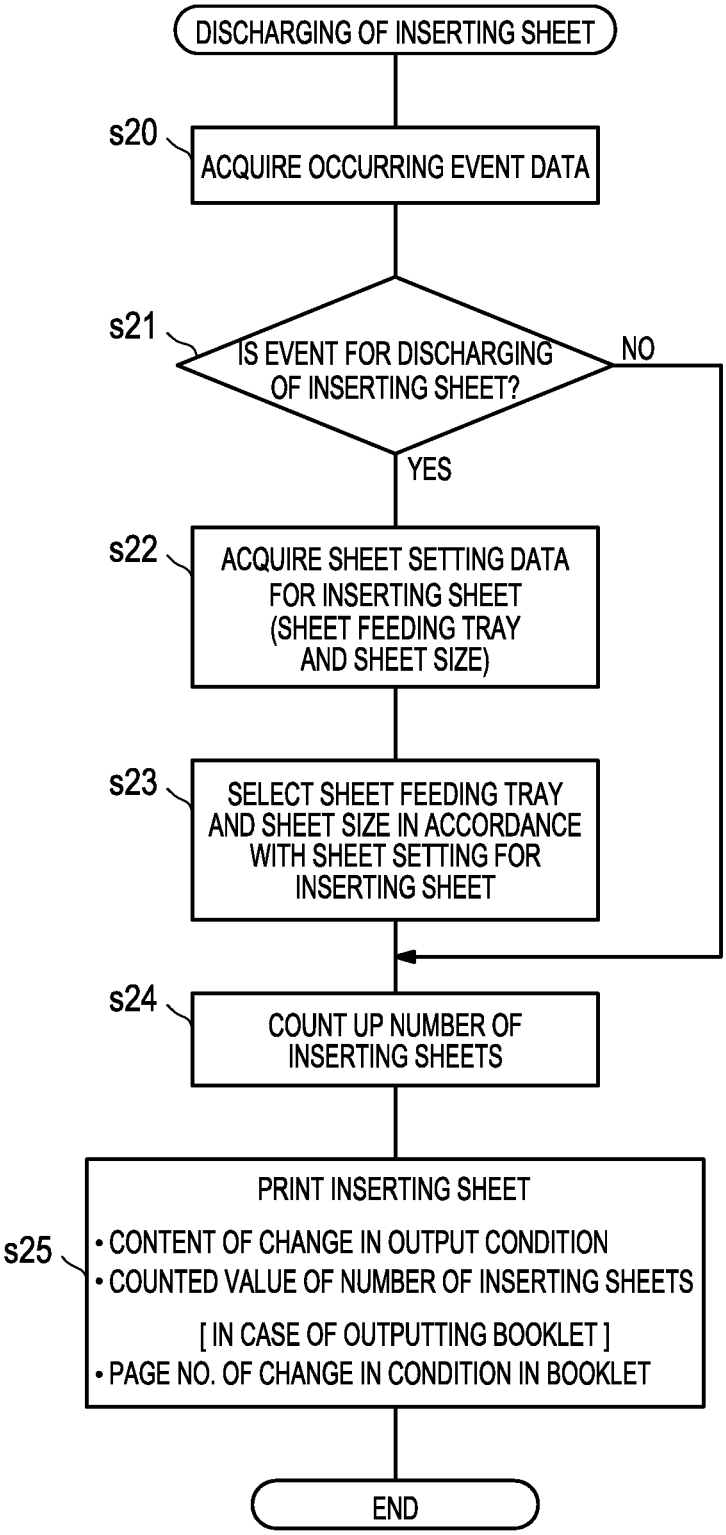
FIG. 5 is a flowchart that illustrates the sequence of inserting an inserting sheet in detail.

Next, out of the sequences illustrated in FIGS. 3 and 4, the inserting sheet discharging sequence will be described in detail with reference to a flowchart illustrated in FIG. 5.

In accompaniment with the occurrence of a change in the output conditions, occurring event data is acquired in Step s20. Subsequently, it is determined whether or not an event in which the change in the output condition has occurred is an event for which an inserting sheet is to be discharged in Step s21. The event for which an inserting sheet is to be discharged may be set and registered in advance by a user. Alternatively, the above-described event may be registered in advance. The determination is performed for discharging an inserting sheet only in a case where a registered event occurs. As events that may be registered, there are adjustment of the image density, a jamming, a change of the recording sheet, a change of the print material, and the like. The change in the recording sheet, for example, is performed in the middle of a job in accordance with the set content of the job. As the change in the recording sheet, there is a change in the paper type, the sheet size, the weight, or the like. In addition, the recording sheet may be changed in a case where there is an instruction for switching between trays. The jamming occurs when a recording sheet that is fed from a sheet feeding tray and is conveyed inside the image forming apparatus has a paper jamming. The change in the material occurs when the material changes due to the replacement of a toner bottle or the like. The image quality may be influenced by an individual difference of toner disposed inside the toner bottle.

In addition, even in a case where the adjustment of the density of the image has been registered, the discharging of an inserting sheet may be configured to be performed only in a case where a value of adjustment exceeds a predetermined value. In such a case, in a case where a slight adjustment, of which the value of adjustment is the predetermined value or less, is performed, the discharging of an inserting sheet is not performed.

For example, the attachment amount of a toner image generated on the image carrier changes due to factors of environments and the like. Accordingly, an attachment amount detecting section used for detecting the attachment amount of the toner image generated on the image carrier is installed to the image forming apparatus. By using the image forming section, a toner patch for the detection is formed on the image carrier, and the attachment amount thereof is detected by the attachment amount detecting section. Based on the detected value of the attachment amount that has been detected in this manner, the image density is adjusted such that an image having an appropriate image density is output. The degree of the adjustment of the image density is not clear every time, and the occurring timing thereof is undetermined.

In an event of changing the output condition of which the degree of adjustment may be different every time, an inserting sheet may be discharged for a predetermined degree of adjustment or higher. From this, for a change in the output conditions of which the influence on the printing quality is low, an inserting sheet is not discharged, whereby excessive inspection can be excluded. Here, the predetermined degree of adjustment may be configured to be set by a setting section. In addition, the predetermined degree of adjustment may be set by the setting section for each user or each job. Furthermore, an event of changing the output condition may be configured to be set in which whether an inserting sheet is discharged or not is determined in accordance with the degree of adjustment. This may be configured to be set for each user, each job, or the like.

In a case where the event in which a change in the output condition occurs is not an event for discharging an inserting sheet (NO in Step s21), the number of inserting sheets is counted up in Step s24. On the other hand, in a case where the event in which a change in the output condition occurs is an event for discharging an inserting sheet (YES in Step s21), sheet setting data for an inserting sheet is acquired from the storage section in Step s22. As an example of the sheet setting data, a sheet feeding tray and a sheet size may be used. After the sheet setting data is acquired in Step s22, a sheet feeding tray and a sheet size are set in accordance with the sheet setting in Step s23. In addition, in a case where the type of the sheet is set so as to match the event of changing the output condition, the type of the sheet is determined in accordance therewith. Furthermore, in a case where the type of sheet is set for each job, the type of the sheet is determined in accordance therewith.

Subsequently, the number of the inserting sheets is counted up in Step s24. Thereafter, printing is performed for the inserting sheets in Step s25.

In Step s25, the content of the change in the output condition and the counted value of the number of the inserting sheets are printed on the inserting sheets. In addition, in the case of printing a booklet, a page No. at which the change in the output condition has occurred in the booklet is printed. When printing is performed for the inserting sheets, the process ends.

Figure 6:
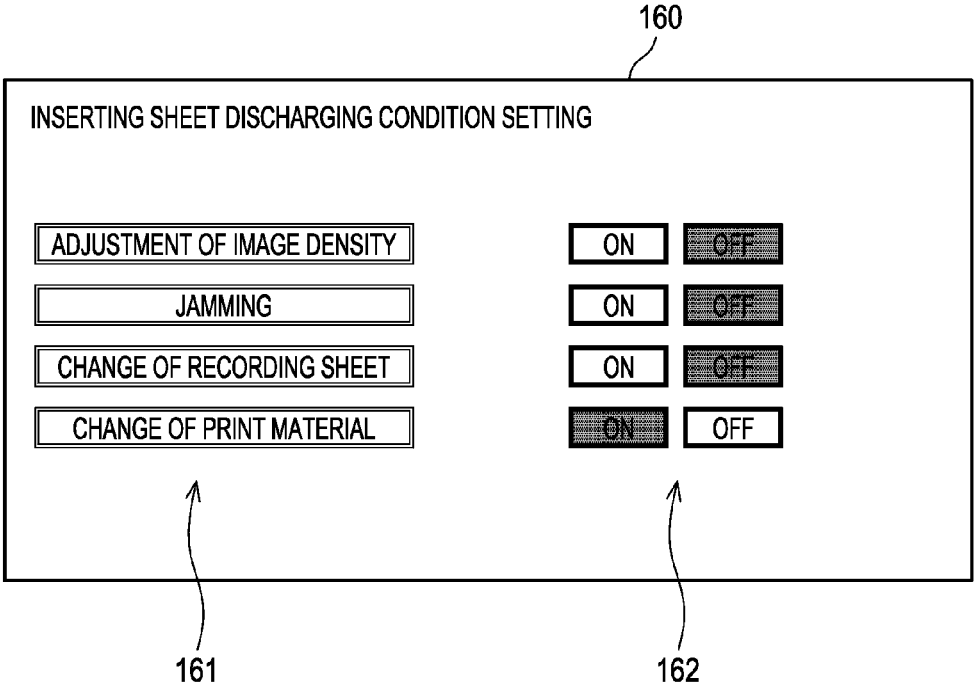
FIG. 6 is a diagram that illustrates a screen for setting inserting sheet inserting conditions.

FIG. 6 is a diagram that illustrates an inserting sheet discharging condition setting screen 160 used by a user for setting an event of changing the output condition for which an inserting sheet is discharged.

On the inserting sheet discharging condition setting screen 160, an event list 161 of events that can be registered is displayed, and an ON/OFF setting button 162 is disposed for each event. In this example, as events that can be registered, the adjustment of the image density, a jamming, a change of the recording sheet, and a change of the print material can be selected. In addition, only in a case where the print material is changed, the discharge of an inserting sheet is registered to be performed at the time of the occurrence of the change.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

an image forming section configured to form an image including a patch image on a recording sheet;

a detecting section configured to detect a density of the image formed by the image forming section; and a controller to control the image forming section and adjust a value of the density of the image based on a result detected by the detecting section, wherein the controller determines whether a value of an adjustment of the image density is larger than a predetermined value or not, and discharges an inserting sheet onto the recording sheet having the image formed during an execution of a job when the value of the adjustment is larger than the predetermined value.

2. The image forming apparatus of claim 1, further comprising a setting section configured to set at least one of the predetermined value to which the value of the adjustment is compared, a type of the inserting sheet, and a tray for storing the recording sheet.

3. The image forming apparatus of claim 2, wherein the setting section is enabled to set the predetermined value to which the value of the adjustment is compared, the type of the inserting sheet, or the tray for storing the recording sheet for each job.

4. The image forming apparatus of claim 1, wherein the controller discharges the inserting sheet a type of which is different from the type of the recording sheet.

5. The image forming apparatus of claim 1, wherein the controller discharges the inserting sheet to a position different from a discharge position of the recording sheet.

6. The image forming apparatus of claim 1, wherein when the controller discharges a plurality of the inserting sheets for one job, the image forming section forms a serial number on each of the inserting sheets.

7. The image forming apparatus of claim 1, wherein when the controller discharges a plurality of the inserting sheets for one job, the image forming section forms a number of the plurality of the inserting sheets on the inserting sheet.

8. The image forming apparatus of claim 1, wherein the controller discharges the inserting sheet before discharging the recording sheet having the image density to which the adjustment of the value larger than the predetermined value is performed.

9. The image forming apparatus of claim 1, wherein when the image forming section forms a series of images on a plurality of the recording sheets, the controller discharges the plurality of the recording sheets followed by the inserting sheet.

10. The image forming apparatus of claim 1, wherein the controller discharges the inserting sheet which has information concerning an adjustment of image density by the controller.

11. The image forming apparatus of claim 10, wherein the information concerning the adjustment is a timing at which the image density is adjusted by the controller.

12. The image forming apparatus of claim 11, wherein the timing is represented by a page number of the recording sheet on which the image having the image density adjusted by the controller is formed.

13. The image forming apparatus of claim 10, wherein the controller discharges the inserting sheet a type of which represents the information of the adjustment.

14. The image forming apparatus of claim 10, wherein the image forming section forms the information concerning the adjustment on the inserting sheet discharged by the controller.

15. An image forming apparatus comprising:

an image forming section configured to form an image on a recording sheet;

a controller to execute a job; and a detecting section configured to detect any of a change of the recording sheet from a first recording sheet to a second recording sheet a type of which is different from a type of the first recording sheet, a change of a material used for the formation of the image, and an occurrence of a jamming, wherein, when the controller detects any of the change of the recording sheet from the first recording sheet to the second recording sheet the type of which is different from the type of the first recording sheet, the change of the material used for the formation of the image, and the occurrence of a jamming during an execution of the job, the controller discharges an inserting sheet onto the recording sheet having the image formed during the execution of the job to inform a user of any detection of the change of the recording sheet from the first recording sheet to the second recording sheet type of which is different from the type of the first recording sheet, the change of the material used for the formation of the image, and the occurrence of a jamming.

* * * * *